United States Patent [19]

Nogi et al.

[11] Patent Number: 4,560,154

[45] Date of Patent: Dec. 24, 1985

[54] PAPER SHEET FEED-OUT DEVICE FOR A PAPER SHEET COUNTING APPARATUS

[75] Inventors: Hiroyoshi Nogi; Hiroyuki Ookawa, both of Tokyo, Japan

[73] Assignee: Musashi Engineering Kabushiki Kaisha, Tokyo, Japan

[21] Appl. No.: 562,700

[22] Filed: Dec. 19, 1983

[30] Foreign Application Priority Data

Dec. 28, 1982 [JP] Japan ..... 57-195909
Jan. 31, 1983 [JP] Japan ..... 58-11078

[51] Int. Cl.[4] ..... B65H 3/06; B65H 5/06

[52] U.S. Cl. ..... 271/10; 271/116; 271/119; 271/122; 271/274

[58] Field of Search ..... 271/4, 272, 273, 274, 271/121, 122, 124, 125, 119, 116, 10

[56] References Cited

U.S. PATENT DOCUMENTS 3,838,851 10/1974 Kolibas ..... 271/116 X

FOREIGN PATENT DOCUMENTS 0001134 1/1982 Japan ..... 271/119
0011438 1/1983 Japan ..... 271/116
0022230 2/1983 Japan ..... 271/273
2035268 6/1980 United Kingdom ..... 271/122

*Primary Examiner*—Duane A. Reger
*Assistant Examiner*—Lawrence J. Goffney, Jr.
*Attorney, Agent, or Firm*—Brooks, Haidt, Haffner & Delahunty

[57] ABSTRACT

In apparatus for counting the number of the paper sheets in which paper sheets are fed-out from the inside of the hopper by a feed-out roll assembly and are extracted from the feed-out roll assembly by extracting rolls operating at a speed faster than the speed of the feed-out assembly, the feed-out roll assembly comprises a pair of first payout rolls having a frictional surface and a slippery surface on their peripheries and a second payout roll intermediate the first payout rolls which has a frictional surface on its entire periphery. The rolls are mounted on a driving shaft, and at least the second payout roll is connected to the driving shaft through an overrunning clutch. When the trailing end of the paper sheet being removed from the hopper is in contact with the slippery surfaces of the first payout rolls, the sheet is extracted by the extracting rolls at a constant speed equal to the speed of the extracting rolls and thus, without being affected by the peripheral speed of the feed-out roll assembly.

6 Claims, 5 Drawing Figures

PAPER SHEET FEED-OUT DEVICE FOR A PAPER SHEET COUNTING APPARATUS

BACKGROUND OF THE INVENTION

This invention relates to an apparatus for counting the number of paper sheets in which the sheets fed out by a set of payout rolls are extracted by a set of extracting rolls. More particularly, it relates to an improvement in the payout rolls employed in such apparatus.

Heretofore, in this type of the counting apparatus for paper sheets, the payout rolls are fixed on their driving shaft, so that the paper sheets are affected by these payout rolls rotating at a slower speed than that of the extracting rolls during the time the sheets contacted by the payout rolls are extracted by the extracting rolls. This means that the sheets are braked by the payout rolls during transport and hence are transported at a variable speed thus rendering it difficult to accurately sense the abnormal transport state of the paper sheets at the sensing device.

SUMMARY OF THE INVENTION

It is an object of the present invention to provide means for effectively obviating the aforementioned drawback of the prior-art apparatus. According to the invention, a payout roll assembly comprising of a pair of first feed-out or payout rolls having a frictional surface and a slippery surface on its periphery and a second feedout or payout roll positioned intermediate these first payout rolls and having a frictional surface on its overall periphery is mounted on a payout roll shaft provided adjacent to the paper sheet outlet of the hopper. At least said second payout roll is mounted on the payout roll shaft through an overrunning clutch. The arrangement is so made that, while the one end of the paper sheet being taken out is contacted with the slippery surface of the first payout roll, the sheet is extracted by the extracting rolls at a constant speed equal to the speed of the extracting rolls and thus without being affected by the peripheral speed of the payout roll assembly.

DESCRIPTION OF THE PREFERRED EMBODIMENTS

Reference is now had to the accompanying drawings for describing certain preferred embodiments of the paper sheet counting device according to the present invention.

Figure 1:
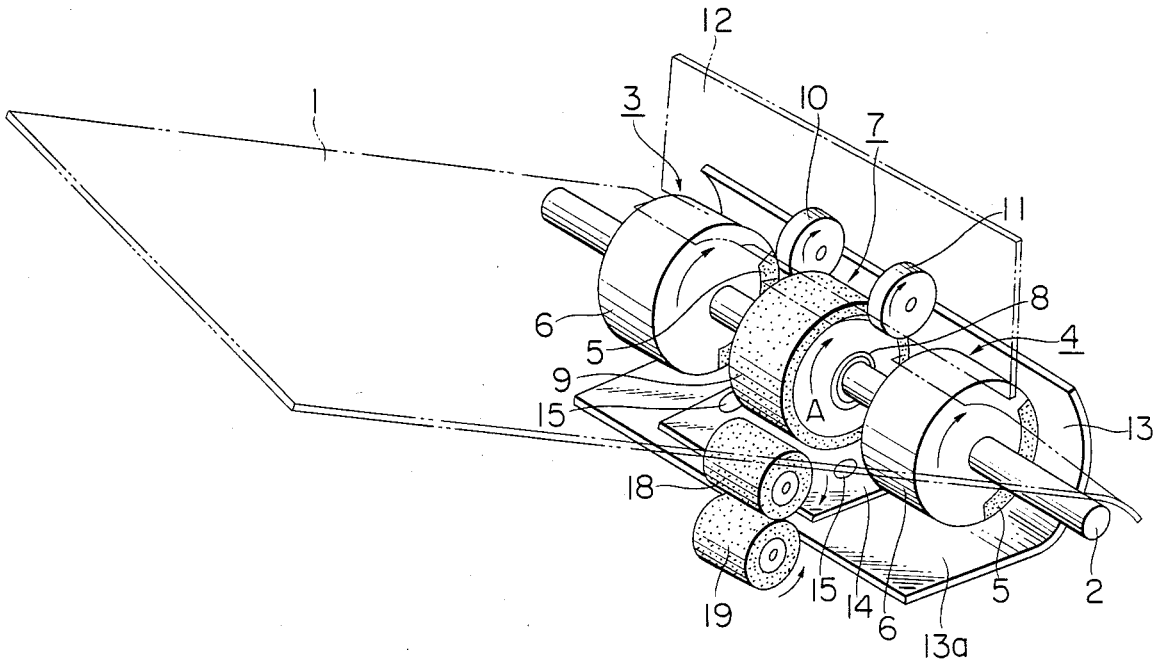
FIG. 1 is a perspective view showing a first embodiment of the paper sheet feed-out device of the paper sheet counting apparatus according to the present invention.
Figure 2:
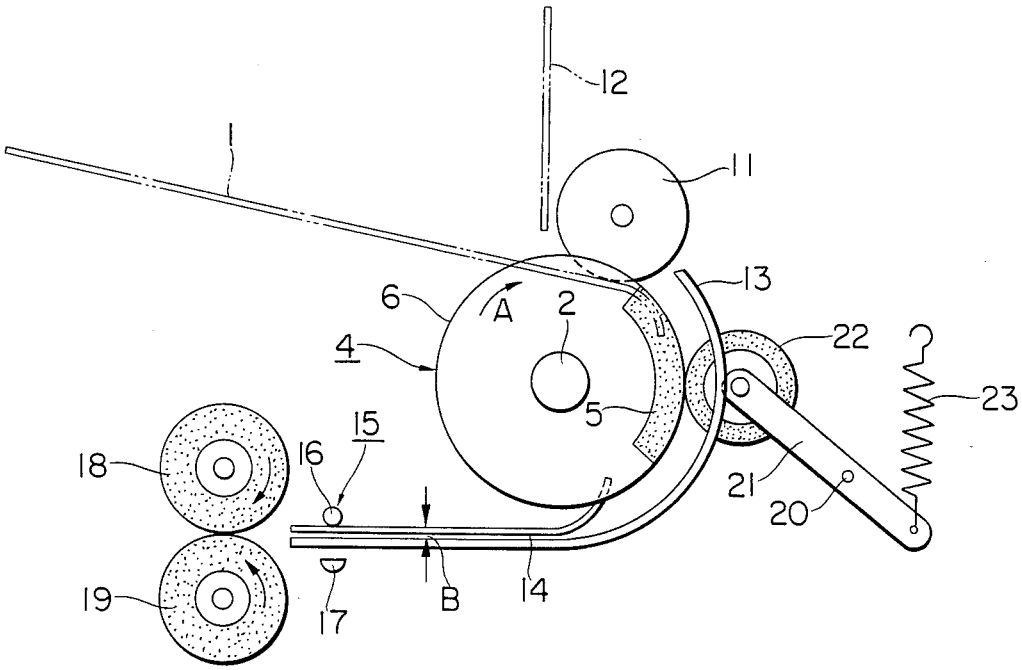
FIG. 2 is a side elevation of the embodiment shown in FIG. 1.

Referring to FIGS. 1 and 2, the numeral 1 designates a hopper base plate on which to stack the paper sheets. In the neighborhood of the lower end of the hopper base plate 1, and on a payout roll shaft 2, which is mounted for rotation on a main body, not shown, there are securely mounted a pair of spaced apart first payout rolls 3, 4. The peripheral surface of each of said first payout rolls 3, 4 is formed by a frictional surface 5 formed of frictional material such as rubber and a slippery surface 6 which is less frictional than the surface 5. The circumferential length of the frictional surface 5 is selected to be shorter than the length of the paper sheet in the transport direction of the sheet. Intermediate the first payout rolls 3, there is mounted a second payout roll 7 on the payout roll shaft 2 by means of a well-known overrunning clutch 8 so that the second payout roll 7 may be rotated freely in the sheet payout direction or in the direction of the arrow mark A relative to the payout roll shaft 2 but locked against rotation in the opposite direction. The entire peripheral surface of the second payout roll is formed by a second frictional surface 9 formed of the same material as the aforementioned first frictional surface 5. A pair of separating rolls 10, 11 are mounted in the neighborhood of both ends of the second payout roll 7 and are adapted to be rotated for separating the paper sheets in the same counterclockwise rotational direction as the first and second payout rolls 3, 4 by means of a driving shaft, not shown. A paper sheet receiving surface 12 is mounted upright close to these separating rolls 10, 11 or at the upstream side relative to the advancing direction of the paper sheets. A substantially J-shaped first guide plate 13 is mounted so as to extend from the right upper side to the left lower side of the payout rolls 3, 4 and 7 when seen in FIG. 2 and a second guide plate 14 configured similarly to the first guide plate 13 is mounted above and with a predetermined gap B from a flat portion 13*a* of first guide plate 13. It is through this gap B that the paper sheets are conveyed. A paper sheet sensor 15 made up of a light emitting element 16 and a light receiving element 17 is mounted at the ends of the first and second guide plate 13, 14 downstream of the advancing direction of the paper sheets. A pair of extracting rolls 18, 19 is mounted adjacent to and downstream of the paper sheet sensor for rotation in the direction of the arrow mark shown in FIG. 2.

The outer periphery of the second payout roll 7 is contacted by a pinch roll 22 rotatably supported by a supporting shaft 20, as shown in FIG. 2. The lever 21 is biased by a spring 23 which is connected to the opposite side of the lever 21 in such a manner that the pinch roll 22 abuts on the second payout roll 7 with a sufficient pressure.

With the aforementioned construction, the operation of the paper sheet payout device of the paper sheet counting apparatus according to the present invention is hereafter described. The paper sheets, not shown, stacked on the hopper base plate 1 are separated and taken out one by one through cooperation of the separating rolls 10, 11 and the first frictional surfaces 5 of the first payout rolls 3, 4 when the paper sheets are contacted with the surfaces 5. When the leading edge of the advancing paper sheet has arrived at the pinch roll 22, the sheet is clamped between the frictional surface 9 provided on the overall periphery of the second payout roll 7 and the similar frictional surface of the pinch roll 22 and is advanced further in this state. When the trailing half of the paper sheet has arrived at a position contacting with the slippery surfaces 6 of the first payout rolls 3, 4, the leading edge of the paper sheet has already travelled beyond the guide plates 13, 14 and are forcibly extracted by the extracting rolls 18, 19 rotated at a constant speed faster than the peripheral speed of the payout rolls 3, 4. At this time, since the second payout roll 7 is free to rotate in the direction A under the operation of the overrunning clutch 8, it is rotated by the sheets at a peripheral speed faster than that of the first payout rolls 3, 4. Therefore, the speed of the paper sheet travelling through the sensor 15 is practically not governed by the peripheral speed of a payout roll assembly essentially comprising the first payout rolls 3, 4. In other words, since the second payout roll 7 is incapable of braking the movement of the paper sheet, the latter may be transported at a constant speed approximately equal to the peripheral speed of the extracting rolls 18, 19.

Figure 3:
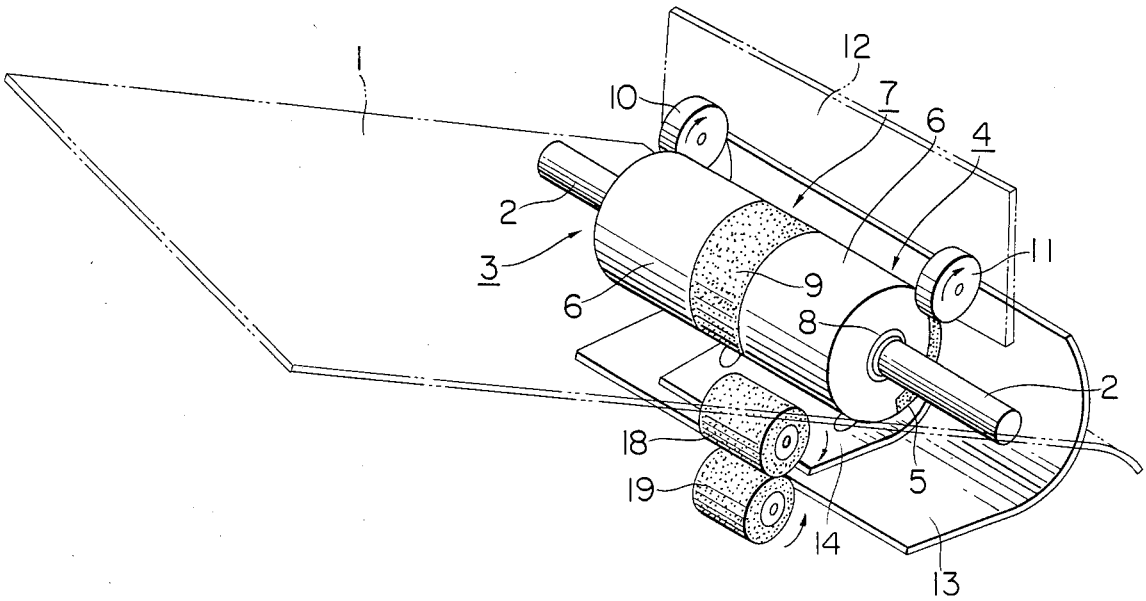
FIG. 3 is a perspective view showing a second embodiment of the paper sheet feed-out device of the paper sheet counting apparatus according to the present invention.

FIG. 3 shows in perspective a second embodiment of the present invention. In the preceding embodiment, the first and second payout rolls 3, 4, 7 are separate from one another, only the second payout roll 7 being mounted on the payout roll shaft 2 through the overrunning clutch 8, and the separating rolls 10, 11 are mounted at each end of the first payout rolls 3, 4. In the second embodiment, the first and second payout rolls 3, 4, 7 are integral with one another as shown. Hence, all of these rolls 3, 4, 7 are mounted on the roll shaft 2 through the intermediary of the overrunning clutch 8, and the separating rolls 10, 11 are positioned close to the outer ends of the first payout rolls 3 and 4 or ends thereof spaced from the second payout roll 7. The detailed structure of the present second embodiment is otherwise similar to that of the aforementioned first embodiment.

Figure 5:
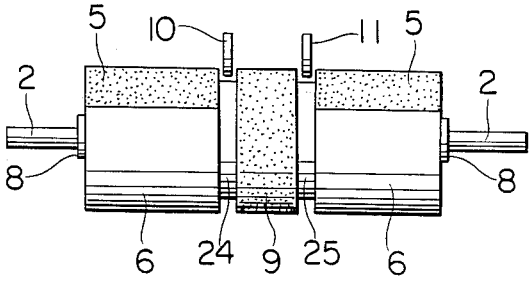
FIG. 5 is a front view showing a modification of the payout roll shown in FIG. 4.

In the payout roll assembly shown in FIG. 5, a pair of circumferential grooves 24, 25 are formed on the roll periphery and the separating rolls 10, 11 are positioned opposite to these grooves.

Figure 4:
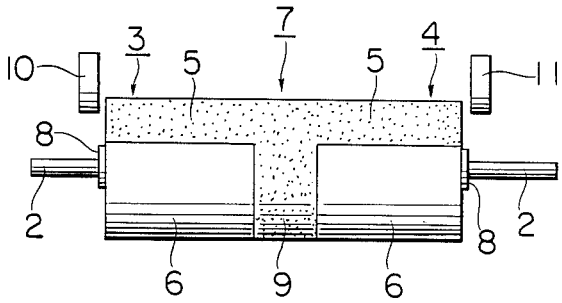
FIG. 4 is a front view showing the payout roll of the second embodiment shown in FIG. 3.

The operation of the paper sheet counting apparatus shown in FIGS. 3 to 5 is similar to that of the preceding first embodiment.

From the foregoing it will be appreciated that the arrangement according to the present invention provides a paper sheet feed-out device for the paper sheet counting apparatus in which the paper sheets may be conveyed through the sensor at a constant speed which is not influenced substantially by the operation of the payout rolls but which is determined only by the peripheral speed of the extracting rolls thus allowing the abnormal transport state of the paper sheets at the paper sensor to be detected accurately, thus enhancing the operational reliability of the paper sheet counting apparatus.

In addition, when the paper sheet payout rolls are not separated but are integral with one another, the paper sheets can be extracted more reliably by means of the extracting rolls, the overall structure may be simplified and the manufacture costs lowered without affecting the operational reliability.

What is claimed is:

1. An apparatus for counting the number of paper sheets in which the sheets stored in a hopper are fed out by a feed-out device and the paper sheets thus fed out are extracted by extracting rolls at a speed faster than the feedout speed, said feed-out device comprising a driving shaft provided adjacent to a paper sheet outlet in the hopper;

a pair of axially spaced apart, first feed-out rolls mounted on said driving shaft, each roll having a peripheral surface portion, less in extent than the periphery of the roll, which provides a first frictional surface and the remaining portion of the peripheral surface providing a slippery surface which is less frictional than said first frictional surface, said peripheral surface portion of one said roll being aligned in the axial direction of said shaft with the peripheral surface portion of the other said roll;

a second feed-out roll mounted on said driving shaft intermediate said first feed-out rolls and having a second frictional surface extending for the full extent of the periphery of said second feed-out roll, said second frictional surface being of a material presenting a frictional force substantially equal to that of said first frictional surface; and interconnecting means acting intermediate said driving shaft and at least said second feed-out roll for rotating at least said second feed-out roll by said driving shaft, said interconnecting means causing said second feed-out roll to be rotated in the same direction as said first feed-out rolls but permitting said second feed-out roll to be rotatable in said direction at a speed faster than said first feed-out rolls whereby said second feed-out roll may rotate freely in the paper sheet feed-out direction.

2. The apparatus as claimed in claim 1, wherein said second feed-out roll is axially spaced from said first reed-out rolls and said first feed-out rolls are secured to said driving shaft for rotation thereby.

3. The apparatus as claimed in claim 1, wherein said first and second feed-out rolls are integral with one another and said interconnecting means also interconnects said first feed-out rolls with said driving shaft.

4. The apparatus as claimed in claim 1, wherein said interconnecting means is an overrunning clutch.

5. The apparatus as claimed in claim 1, wherein the nip of said extracting rolls is spaced from said first feed-out rolls by an amount at least equal to the peripheral length of said first frictional surface whereby when a paper sheet is in said nip the paper sheet is engaged by the remaining portions of said first feed-out rolls.

6. Apparatus for feeding paper sheets, said apparatus comprising:

a hopper for storing said sheets;

feed-out roll means mounted adjacent said hopper for removing said sheets from said hopper, said feed-out roll means comprising a driving shaft for rotating said feed-out roll means and having a pair of axially spaced apart, peripheral surfaces and a further peripheral surface intermediate said pair of axially spaced apart peripheral surfaces for engaging said sheets to remove them from said hopper, each of the pair of peripheral surfaces being provided by a first frictional portion which extends partly around the periphery of the roll means and a second slippery portion which is less frictional than said first portion extending around the remainder of the periphery of the roll means, the first frictional portion of one of said pair of peripheral surfaces being axially aligned with the first frictional portion of the other of said pair of peripheral surfaces, and said further peripheral surface extending for the full extent of the periphery of said roll means and being made of a material having the friction characteristics of said first frictional portion;

interconnecting means interconnecting said roll means with said driving shaft for rotating said roll means by said driving shaft, said interconnecting means including means for permitting said further peripheral surface to be rotated faster than it is driven by said driving shaft; and extracting roll means for extracting said sheets from said feed-out roll means, said extracting roll means being spaced from said feed-out roll means by a distance which delays gripping of a sheet by said extracting roll means until the sheet has been released by the first frictional portions of said pair of peripheral surfaces.

* * * * *